US011866229B2

(12) United States Patent
Bores

(10) Patent No.: US 11,866,229 B2
(45) Date of Patent: Jan. 9, 2024

(54) AUTOMATABLE CLOSURE

(71) Applicant: ENTEGRIS, INC., Billerica, MA (US)

(72) Inventor: Gregory Bores, Prior Lake, MN (US)

(73) Assignee: ENTEGRIS, INC., Billerica, MA (US)

( * ) Notice: Subject to any disclaimer, the term of this patent is extended or adjusted under 35 U.S.C. 154(b) by 0 days.

(21) Appl. No.: 17/695,284

(22) Filed: Mar. 15, 2022

(65) Prior Publication Data

US 2022/0204218 A1 Jun. 30, 2022

Related U.S. Application Data

(62) Division of application No. 16/130,484, filed on Sep. 13, 2018, now Pat. No. 11,345,519.

(51) Int. Cl.
*B65D 41/04* (2006.01)
*B65D 39/00* (2006.01)

(52) U.S. Cl.
CPC ..... *B65D 41/0428* (2013.01); *B65D 41/0478* (2013.01); *B65D 41/0485* (2013.01); *B65D 39/0076* (2013.01)

(58) Field of Classification Search
CPC ..... B65D 41/0428; B65D 41/0485; B65D 41/0478; B65D 39/0076; B65D 50/046; B65D 45/02; B65D 47/247; B65D 49/08; B65B 7/28
USPC ..... 215/329
See application file for complete search history.

(56) References Cited

U.S. PATENT DOCUMENTS

| | | | | |
|---|---|---|---|---|
| 4,511,049 | A | 4/1985 | Aboud | |
| 4,864,966 | A * | 9/1989 | Anderson | B05B 13/0431 427/427.2 |
| 5,431,293 | A | 7/1995 | Piron | |
| 8,833,578 | B1 | 9/2014 | Shell-Schnitzer | |
| 9,043,019 | B2 * | 5/2015 | Eliuk | G07F 11/70 221/9 |
| 2003/0061911 | A1 | 4/2003 | Niwayama | |
| 2009/0071976 | A1 | 3/2009 | Drennow | |
| 2009/0212954 | A1 | 8/2009 | Adstedt | |
| 2012/0177473 | A1 * | 7/2012 | Smith | G07F 17/0092 414/744.3 |
| 2014/0076896 | A1 | 3/2014 | Aneas | |

(Continued)

FOREIGN PATENT DOCUMENTS

| | | |
|---|---|---|
| CN | 102046485 B | 8/2014 |
| CN | 204701944 U | 10/2015 |

(Continued)

*Primary Examiner* — Ernesto A Grano

(57) ABSTRACT

A cap for a fluid container includes a main body, an actuator ring slidable along the main body and having an annular groove, and a plurality of latches having secure and release states and that may be placed in the release state by contact with the actuator ring. A closure system for a fluid container includes the cap, and a lip attached to a fluid container that is engaged by the latches of the cap. The lip may be integral with a fluid container or part of an adapter that is connected to the fluid container. A method of automated handling of a container includes engaging an annular groove of an actuator ring of a cap using a robotic arm, driving the actuator ring, and removing the cap from the container. The method may further include transporting the container via engagement of the robotic arm with the cap.

12 Claims, 10 Drawing Sheets

(56) References Cited

U.S. PATENT DOCUMENTS

| | | | | |
|---|---|---|---|---|
| 2014/0166654 | A1 | 6/2014 | Marvin | |
| 2014/0174028 | A1* | 6/2014 | Yamagata | G01N 35/00 53/287 |
| 2014/0353274 | A1 | 12/2014 | Benson | |
| 2016/0152385 | A1 | 6/2016 | Wohlgenannt | |
| 2016/0280427 | A1 | 9/2016 | Wu | |
| 2017/0015005 | A1* | 1/2017 | Joplin | B65B 9/045 |
| 2018/0072551 | A1* | 3/2018 | Burkhard | B67C 3/225 |
| 2019/0084705 | A1 | 3/2019 | Wei | |
| 2019/0092535 | A1* | 3/2019 | Circosta | B65D 41/0485 |
| 2019/0100358 | A1 | 4/2019 | Takayanagi | |
| 2019/0315526 | A1 | 10/2019 | Gómez Cao | |

FOREIGN PATENT DOCUMENTS

| | | | |
|---|---|---|---|
| JP | 61103000 | A | 5/1986 |
| JP | 2010537903 | A | 12/2010 |
| JP | 2017537668 | A | 12/2017 |
| KR | 20170099536 | A | 9/2017 |

* cited by examiner

AUTOMATABLE CLOSURE

CROSS REFERENCE TO RELATED APPLICATIONS

This application is a divisional of U.S. patent application Ser. No. 16/130,484 filed Sep. 13, 2018, the disclosure of which is hereby incorporated herein by reference in its entirety.

FIELD

This disclosure relates generally to an enclosure for containing a fluid. More specifically, the disclosure relates to a cap and closure system, method, and component for containing a fluid.

BACKGROUND

Some manufacturing processes utilize liquid chemicals. The liquid chemicals may include, for example, acids, solvents, bases, photoresists, dopants, inorganic solutions, organic solutions, pharmaceuticals, or the like. In using such chemicals, a containment system may be utilized to properly contain the chemicals during storage, transport, and ultimately during the manufacturing process itself. The containment systems typically are closed by caps that are screwed into place, connected by threads.

SUMMARY

This disclosure relates generally to an enclosure for containing a fluid. More specifically, the disclosure relates to a cap and closure system, method, and component for containing a fluid.

Caps according to embodiments use a system, actuated using an actuator ring having an annular groove. The annular groove allows the actuator ring to be engaged regardless of a rotational position of the cap or container. A rotation-agnostic system significantly facilitates automation of handling of fluid containers using caps according to embodiments. Using caps according to embodiments allows the movement and opening of fluid containers to be automated, for example using automated materials handling systems such as overhead systems used in semiconductor fabrication.

A cap for a fluid container is disclosed. The cap includes a main body, including a plurality of latches, the plurality of latches having a release state and a secure state, the plurality of latches configured to be in the release state when a portion of each of the plurality of latches are depressed, and an actuator ring. The actuator ring includes an annular groove disposed on an outer side of the actuator ring and an actuation surface disposed on an inner side of the actuator ring. The actuation surface depresses the portion of each of the plurality of latches and the plurality of latches are in the release state. In an embodiment, the plurality of latches includes three or more latches. In an embodiment, the plurality of latches each include a spring configured to hold each latch in the secure state. In an embodiment, each of the plurality of latches includes a resilient material configured to hold each latch in the secure state. In an embodiment, the main body includes at least one of polyether ether ketone or aluminum. In an embodiment, the cap further includes a close-range communication tag. In an embodiment, the main body further includes at least one aperture through which fluid may pass into or out of the container. In an embodiment, a portion of the main body has an outer diameter smaller than an inner diameter of the actuator ring.

A closure system for a fluid container is disclosed. The closure system includes a lip attached to the fluid container, and a cap. The cap includes a main body, including a plurality of latches, each of the plurality of latches having a release state and a secure state, each of the plurality of latches configured to be in the release state when a portion of each of the plurality of latches are depressed; and an actuator ring including an annular groove disposed on an outer side of the actuator ring and an actuation surface disposed on an inner side of the actuator ring. The actuator ring is slidable along the main body between at least a first position wherein the actuation surface does not depress the portion of each of the latches, and a second position wherein the actuation surface depresses the portion of each of the latches and the latches are in the release state, and the plurality of latches engage the lip when in the secure state. In an embodiment, the main body includes a wall extending from a side facing the fluid container towards the fluid container, wherein the wall is configured to fit over the lip when the cap is installed on the container. In an embodiment, the lip is attached to the container via a threaded connector. In an embodiment, the threaded connector comprises a breakable seal configured to seal the contents of the fluid container. In an embodiment, a portion of the main body abuts the seal when the plurality of latches engages the lip. In an embodiment, the lip is formed integrally with the container. In an embodiment, the main body further comprises at least one aperture through which fluid may pass into or out of the container.

A method for automated handling of a container is disclosed. The method includes engaging an annular groove on an actuator ring of a container cap with a robotic arm, driving the actuator ring with respect to a main body of the container cap to release one or more latches disposed on the main body of the container cap, and removing the container cap from the container. In an embodiment, the method further includes attaching a dispensing head to the container via the robotic arm. In an embodiment, the method further includes transporting the container via an overhead materials handling system, including engaging the container cap with the overhead materials handling system. In an embodiment, engaging the container cap with the overhead materials system restricts movement of an actuator ring of the container cap. In an embodiment, engaging the container cap with the overhead materials system includes engaging an annular projection extending from the main body of the container cap.

BRIEF DESCRIPTION OF THE DRAWINGS

References are made to the accompanying drawings that form a part of this disclosure, and which illustrate embodiments in which the systems and methods described in this specification can be practiced.

Like reference numbers represent like parts throughout.

DETAILED DESCRIPTION

This disclosure relates generally to an enclosure for containing a fluid. More specifically, the disclosure relates to a cap and closure system, method, and component for containing a fluid.

Some manufacturing processes utilize liquid chemicals. The liquid chemicals may include, for example, acids, solvents, bases, photoresists, dopants, inorganic solutions, organic solutions, pharmaceuticals, or the like. In using such chemicals, a containment system may be utilized to properly contain the chemicals during storage, transport, and ultimately during the manufacturing process itself.

Embodiments of this disclosure are directed to a cap for a fluid container, a closure system for a fluid container, and methods for automated handling of a container. The cap for a fluid container can be used to seal the fluid container until an appropriate time in a manufacturing process, at which the sealed fluid may be used in a manufacturing process. The cap may protect another seal on the container. The cap may be configured for automated attachment or removal of the cap by an automated materials handling system. The cap may include features allowing engagement of the cap from any direction and manipulation of the cap to release the cap from the fluid container. The cap may be configured to be rotation-agnostic, such that an automated materials handling system may successfully interface with and apply or remove the cap without regard to a rotational orientation of the cap, a rotational orientation of the fluid container, or a combination thereof. The rotational orientation of the cap is a rotational position of the cap about an axis perpendicular to an orifice of the fluid container.

Embodiments of this disclosure include an actuator ring slidable along the main body of the cap and having an annular groove. Materials handling systems may engage the annular groove to manipulate the actuator ring. The actuator ring may include an actuation surface that operates one or more latches that secure the cap to a container. Additionally, some of the manufacturing processes are performed in a clean room. In such environments, the automated closure should minimize the production of contaminants, such as material ablated from the interfaces of the parts of the cap, the automated materials handling system machinery, or both. Additionally, the fluid containers may be moved as well as opened and closed by the materials handling systems. Embodiments of this disclosure include an annular projection allowing engagement of the cap by a materials handling system without opening the cap. Embodiments of this disclosure include the materials handling system engaging the cap in a manner restricting movement of an actuator ring used to release the cap from the container.

A fluid includes, but is not limited to, a substance that flows or deforms when a shear stress is applied. A fluid can include, for example, a liquid.

Figure 1:
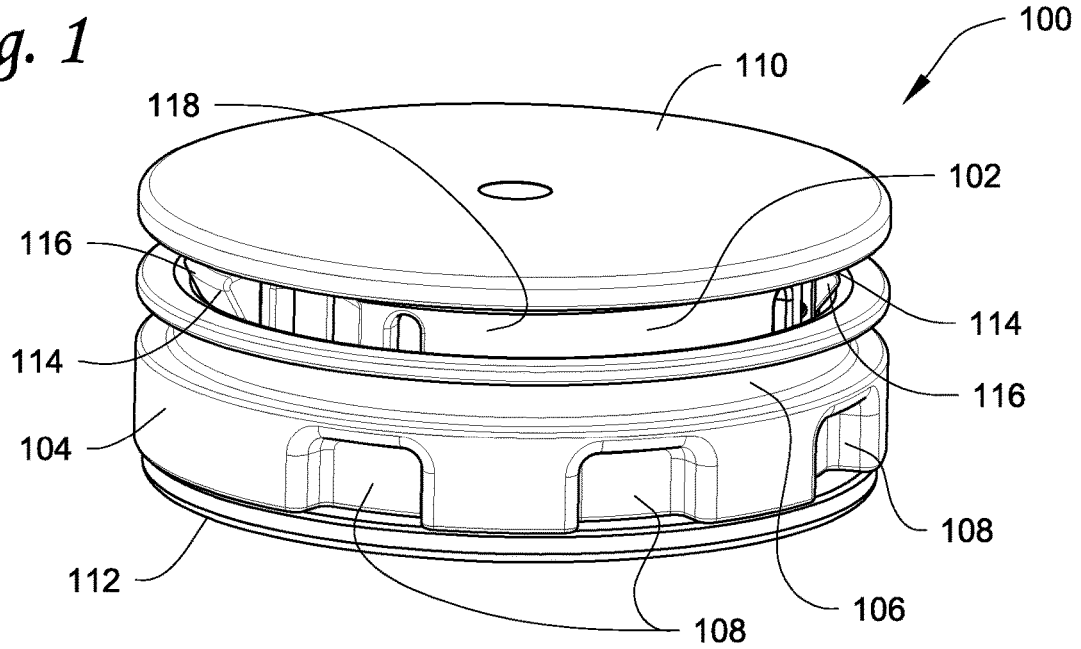
FIG. 1 is a perspective view of a cap for a fluid container, according to an embodiment.

FIG. 1 is a perspective view of a cap 100 for a fluid container according to an embodiment. Cap 100 includes main body 102 and actuator ring 104. Actuator ring 104 includes annular groove 106. In an embodiment, actuator ring 104 includes finger grooves 108. Main body 102 includes top 110 and base 112. Latches 114 are attached to main body 102. A portion 116 of each of the latches 114 extends away from the main body between actuator ring 104 and top 110.

Cap 100 may engage with a container, such as fluid container 506 shown in FIG. 5 and described below, to close the container. The cap 100 can be installed to, for example, store the fluid within the container. Cap 100 includes multiple components, including a main body 102 that has a plurality of latches 114 and an actuator ring 104 that is slidable along main body 102.

Figure 4:
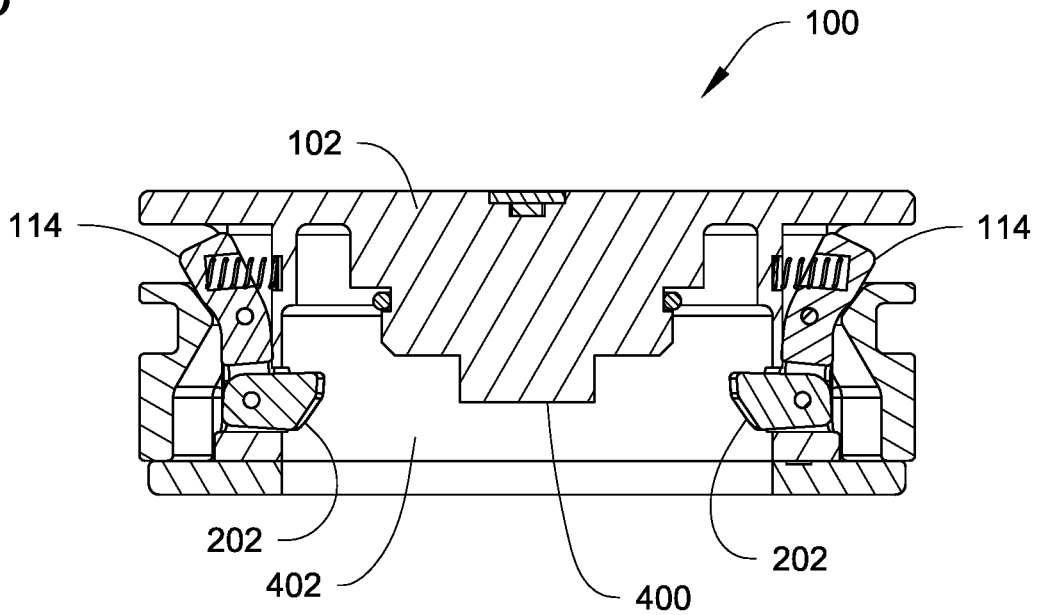
FIG. 4 is a sectional view of the cap for a fluid container of FIG. 1, taken along line A-A in FIG. 3, according to an embodiment.

Main body 102 may have a generally cylindrical shape. A portion 118 of main body 102 is located between top 110 and base 112. Portion 118 is visible in FIG. 2. Portion 118 may have a generally cylindrical shape with an outer diameter less than an inner diameter of actuator ring 104. The ring shape of actuator ring 104 may surround portion 118. Since the outer diameter of portion 118 is smaller than the inner diameter of actuator ring 104, actuator ring 104 may be slidable over portion 118 of main body 102. As shown in FIG. 4 and described in detail below, main body 102 may include a cavity 402 inside of main body 102 and open at base 112. Cavity 402 may be configured to accommodate part of a fluid container, such as a lip or an aperture of the fluid container. Main body 102 may be made of, for example, metals such as aluminum, polymer materials such as high-density polyethylene (HDPE), polyether ether ketone (PEEK), perfluoroalkoxy alkane (PFA), or any other suitable melt-processed polymers, and combinations thereof.

Main body 102 includes top 110. Top 110 may be disc-shaped and have an outer diameter greater than the outer diameter of other parts of main body 102, for example the portion 118 of main body 102 that actuator ring 104 may surround and be slid along. Top 110 may have an outer diameter greater than the inner diameter of actuator ring 104, such that actuator ring 104 may not be slid over top 110. Top 110 may restrict the movement of actuator ring 104 due to the outer diameter of the top 110 interfering with the path of movement of the actuator ring 104. The outer perimeter of top 110 may be engaged by an automated materials handling system in order to lift and move a fluid container 110 to which cap 100 is secured.

Main body 102 may include base 112. Base 112 is ring-shaped, with an opening at the center and located at an end of main body 102 opposite top 110. Base 112 may have an outer diameter greater than the inner diameter of actuator ring 104, such that actuator ring 104 may not be slid over base 112. Base 112 may restrict the movement of actuator ring 104 due to the outer diameter of the base 112 interfering with the path of movement of the actuator ring 104. Base 112 may be a separate piece fixed to the main body 102, for example via one or more screws such as 216 shown in FIG.

2 and described in detail below, an adhesive, or the like. In an embodiment, base 112 is affixed to main body 102 after actuator ring 104 is placed around a portion of main body 102. In an embodiment, base 112 further includes an annular projection extending away from the rest of main body 102 and having an interior diameter greater than the exterior diameter of a lip or an aperture of a container that cap 100 is configured to be applied to. An example of this annular projection is 1210 described below and shown in FIGS. 12A and 12B.

Latches 114 are attached to main body 102. Latches 114 are described in detail in the exploded view of FIG. 2 and the corresponding description below. In the embodiment shown in FIG. 1, the latches are in a secure state. In the secure state, latches 114 are positioned to interface with a part of a container such as a lip to secure cap 100 to the container. Latches 114 may be held in the secure state by, for example, a spring such as 208 shown in FIG. 2 and described in detail below. In an embodiment, latches 114 may be held in the secure state by resilient material disposed between a portion of the latch 114 and the main body 102, for example in an opening or space in main body 102 configured to accommodate latch 114. Latch 114 may include multiple segments, for example a toggle segment 200 and a securing segment 202, shown in FIG. 2 and described in detail below. The segments 200, 202 may be connected together, for example by segment pins 204, shown in FIG. 2 and described in detail below. Each of latches 114 may be connected to main body 102 by, for example, main pins 206, shown in FIGS. 2 and 4 and described in detail below. Latches 114 may be made of, for example, metals such as aluminum, polymer materials such as high-density polyethylene (HDPE), polyether ether ketone (PEEK), perfluoroalkoxy alkane (PFA), or any other suitable melt-processed polymers, and combinations thereof.

Each of latches 114 includes a portion 116 that extends away from the main body 102. In an embodiment, when the latches 114 are in the secure state, portions 116 extend beyond the main body 102. In an embodiment, contact with the actuator ring 104 may press the portions 116, causing compression of a spring or resilient material, and placing the latches 114 into a release state, in which the latches 114 do not engage with the part of a container such as a lip.

Actuator ring 104 surrounds part of main body 102. Actuator ring 104 is generally ring-shaped. Actuator ring 104 has an opening at the center, having inner diameter, and also having an outer diameter. Actuator ring 104 has an inner diameter greater than an outer diameter of a portion of main body 102. Actuator ring 104 includes an actuation surface 210, shown in FIGS. 2 and 4 and described in detail below, configured to contact the latches 114, for example at portions 116.

Actuator ring 104 may be made of, for example, metals such as aluminum, polymer materials such as high-density polyethylene (HDPE), polyether ether ketone (PEEK), perfluoroalkoxy alkane (PFA), or any other suitable melt-processed polymers, or combinations thereof. The materials used for main body 102, latches 114 and actuator ring 104 may be selected with respect to their compatibility with one another, for example to reduce the production of particle contaminants when actuator ring 104 is slid along main body 102 and over latches 114.

Actuator ring 104 includes annular groove 106. Annular groove 106 is a groove configured to receive part of an automated materials handling system, such as a robotic arm, and to be engaged by that part of the automated materials handling system such that it may be slid along main body 102. In an embodiment, annular groove 106 may be engaged by the materials handling system regardless of a rotational position of the cap 100, or to which the fluid container cap 100 is attached. Annular groove 106 may be formed in an outer surface of actuator ring 104. In the embodiment shown in FIG. 1, actuator ring 104 is in a position where the actuation surface 210, shown in FIGS. 2 and 4 and described in detail below, does not depress a portion of latches 114 and thus allows the latches 114 to be in a secure state. In an embodiment, actuator ring 104 may be slid into a position where the actuation surface 210 contacts latches 114, placing the latches 114 into a position corresponding to the release state, where the latches 114 do not engage with a part of a container such as a lip. In an embodiment, annular groove 106 allows actuator ring 104 to be operated and slid along main body 102 by, for example, an automated materials handling system in a rotation-agnostic fashion, regardless of a rotational orientation of the cap 100 about an axis perpendicular to an orifice of a fluid container with which the cap is configured for use.

Actuator ring 104 may include finger grooves 108. Finger grooves 108 may be one or more depressions in the outwards-facing surface of actuator ring 104. Finger grooves 108 may be distributed around the actuator ring 104. Finger grooves 108 may be configured to provide a point for gripping and manipulating actuator ring 104. Finger grooves 108 may also provide structural reinforcement of the actuator ring 104, for example to improve resistance to deformation due to mechanical forces being applied to cap 100.

Figure 2:
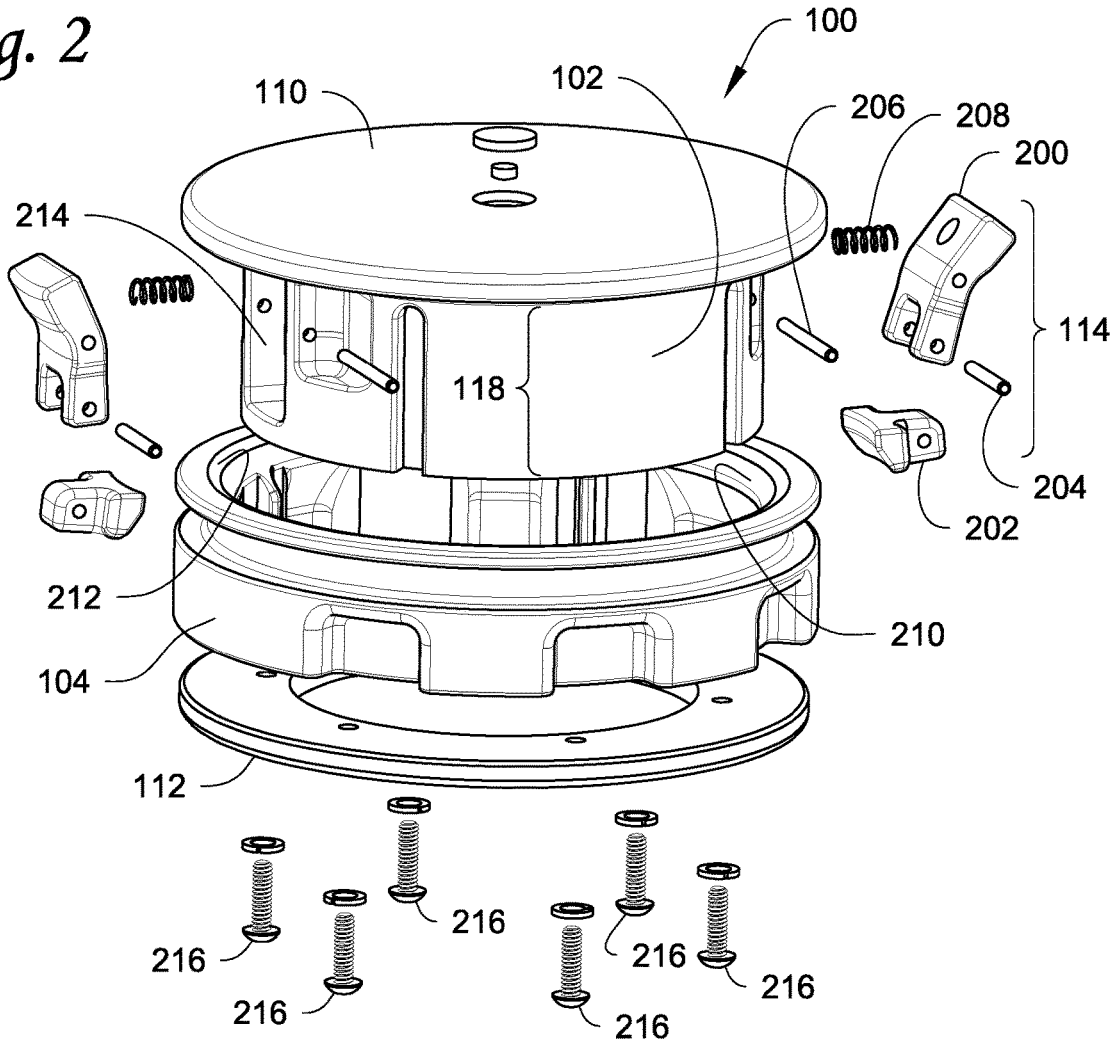
FIG. 2 is an exploded perspective view of the cap of FIG. 1 for a fluid container, according to an embodiment.

FIG. 2 is an exploded perspective view of the cap 100 of FIG. 1 for a fluid container, according to an embodiment. In the exploded view, actuator ring 104 is separated from main body 102, allowing actuation surface 210 to be seen. In the exploded view, bottom 112 of main body 102 is separated from main body 102 and the screws 216 used to attach bottom 112 to the rest of main body 102 can be seen. In the exploded view, latches 114 are separated from main body 102, allowing recesses 214 of main body 102 to be seen and showing main pins 206 that are used to connect latches 114 to main body 102. Further, the exploded view shows latches 114 separated into toggle segment 200, securing segment 202, and segment pin 204 that connects the toggle segment 200 and the securing segment 202. In the exploded view, portion 118 of the main body 102 can be seen.

As can be seen in the exploded view of FIG. 2, each of latches 114 may include toggle segment 200 and securing segment 202, connected by segment pin 204. Toggle segment 200 of latch 114 may be partially located in a recess 214 in main body 102. A portion of each toggle segment 200 may protrude from the recess 214 in main body 102 such that it may be contacted by an actuation surface 210 of actuator ring 104 when the actuator ring 104 is in a particular position along main body 102. Toggle segment 200 may have an elongated shape, with a first end angled with respect to the second end. Toggle segment 200 may have one or more holes for allowing a main pin 206 to connect the toggle segment 200 to the main body 102. Toggle segment 200 may have one or more holes allowing a segment pin to connect the toggle segment 200 to securing segment 202. Toggle segment 200 may include an opening or cavity opposite the part that protrudes from recess 214, configured to accommodate a spring 208 or resilient material.

Securing segment 202 of latch 114 may engage a fluid container to secure cap 100 to the fluid container when in the secure state. Securing segment 202 may disengage from the fluid container when latch 114 is placed into a release state. Main body 102 may include an opening, for example in recess 214, allowing securing segment 202 to protrude into a cavity 402 of main body 102. Cavity 402 is shown in FIG. 4 and described in detail below. In an embodiment, securing segment 202 protrudes into cavity 402 when the latch 114 is in the secure state. Securing segment 202 may have an elongated shape, with a first end configured to engage a container, for example fluid container 506 shown in FIG. 5 and described below, for example at a lip 504, shown in FIG. 5 and described below. Securing segment may have one or more holes at or near a second end, opposite the first, which may allow a segment pin 204 to connect the securing segment 202 to toggle segment 200. When cap 100 is assembled and in the secure state, securing segment 202 may extend through the main body 102, from recess 214 through an opening into cavity 402.

Segment pin 204 connects toggle segment 200 and securing segment 202. Segment pin 204 may allow securing segment 202 to rotate relative to toggle segment 200 such that securing segment 202 moves linearly even when there is a rotational component to the movement of toggle segment 200, for example when an actuation surface 210 of actuator ring 104 is moved such that it contacts the toggle segments 200.

Each toggle segment 200 may be connected to main body 102 by a main pin 206. Toggle segment and main pin 206 may be configured to allow toggle segment 200 to rotate about main pin 206, for example, based on the balance of force applied by spring 208 and actuation surface 210 of actuator ring 104 due to the position of actuator ring 104 along main body 102. Portions of toggle segments 200 may be depressed by contact with actuator ring 104 to actuate latches 114.

Spring 208 is placed between each toggle segment 200 and main body 102. Spring 208 applies a force to toggle segment 200 to put latch 114 into the secure state. In an embodiment, a piece of resilient material such as rubber may be used in place of spring 208. The material, configuration, or combinations thereof of spring 208 may be selected to provide a predetermined force to toggle segment 200 providing a predetermined resistance to the movement of actuation surface 210 of actuator ring 104 over the toggle segment 200. The predetermined resistance may be based, for example, on the actuation mechanism of a materials handling system, a mass of the fluid container with which cap 100 is to be used, or the like.

Actuation surface 210 is an inner surface of actuator ring 104 configured to change the state of latches 114 between the secure and release states based on the position of actuator ring 104. In an embodiment, actuation surface 210 includes a main portion 212 having an interior diameter larger than the exterior diameter of a portion of main body 102, but smaller than a diameter including the protrusion of toggle segments 200 from the main body 102 when in a secure state of the latches 114. Actuation surface 210 may further include a sloped portion 214 from an interior surface of actuator ring 104 to the main portion 212. In an embodiment, when actuator ring 104 is moved, sloped portion 214 is moved over toggle segments 200 of latches 114, until main portion 212 contacts toggle segments 200. Contact between main portion 212 and toggle segments 200 drives toggle segments 200 to rotate about main pins 206.

In the embodiment shown in FIG. 2, base 112 is connected to the rest of main body 102 by screws 216. In an embodiment, six screws 216 are used to secure base 112 to the rest of main body 102. A different number of screws can be used in embodiments. Base 112 may be formed separately from the rest of main body 102 to allow actuator ring to be placed over main body 102 prior to attaching the base 112. In an embodiment, another method of affixing base 112 to the rest of main body 102, such as an adhesive, is used. In an embodiment, base 112 is formed integrally with the rest of main body 102 and actuator ring 104 is formed from parts that are bonded together or otherwise connected around main body 102 between base 112 and top 110.

Figure 3:
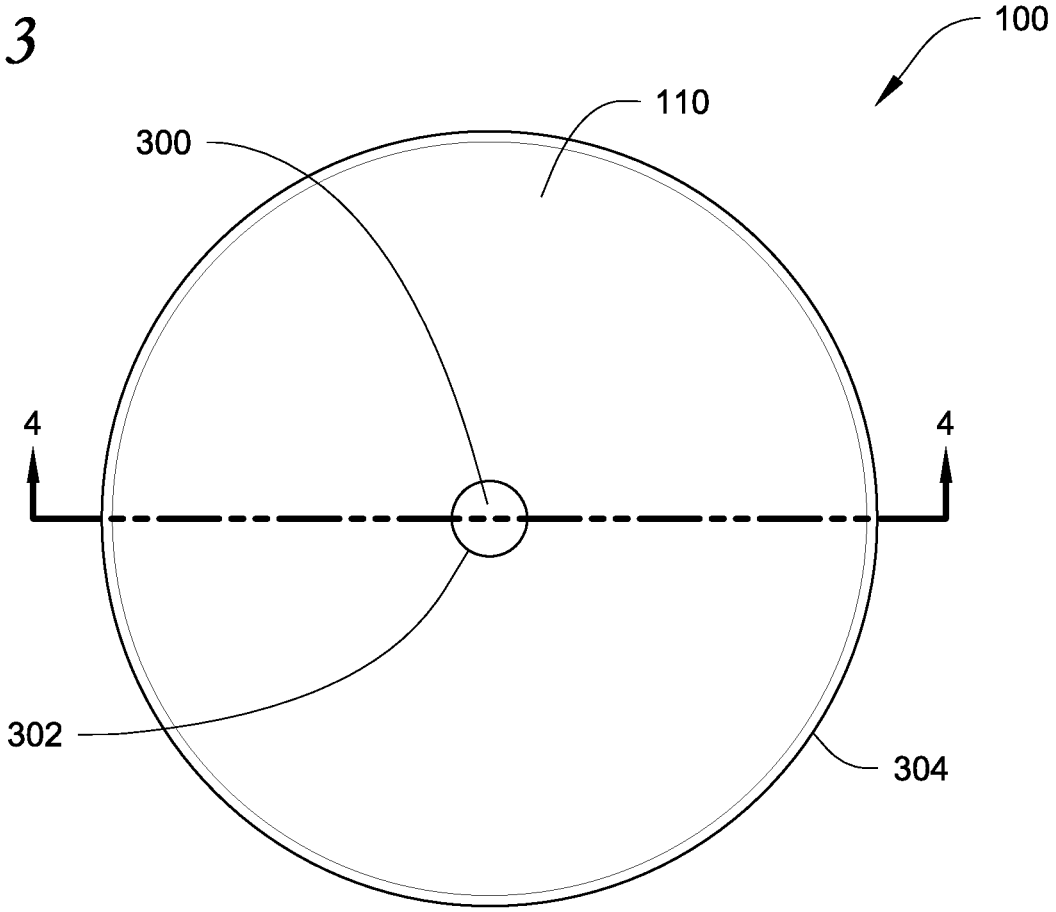
FIG. 3 is a top view of the cap for a fluid container of FIG. 1, according to an embodiment.

FIG. 3 is a top view of the cap 100 for a fluid container of FIG. 1, according to an embodiment. Top 110 of the cap 100 is visible in this view. A short range communication device 302 may be accommodated in the top 110 of cap 100, for example at center 300 of top 110 of the cap 100. An outer edge 304 of the top 110 of cap 100 may be engaged by a materials handling system to move a fluid container to which cap 100 is secured. Other locations on cap 100 may be engaged by the materials handling system to move the fluid container.

Short range communication device 302 allows for electronic recognition of cap 100, for example to track a fluid container that cap 100 is attached to, to track the position and status of cap 100, and the like. Short range communication device 302 may be, for example, a radio-frequency identification (RFID) tag, a near-field communication (NFC) tag, Bluetooth, ZigBee, or the like. Short-range communication device may be an unpowered passive communication device such as an RFID tag. In an embodiment, short-range communication device 302 may be a powered communication device, for example a Bluetooth or ZigBee device, and may further include a battery to supply power to the powered communication device.

FIG. 4 is a sectional view of the cap 100 for a fluid container of FIG. 1, taken along line A-A in FIG. 3, according to an embodiment. In the embodiment shown in FIG. 4, the latches 114 are in the secure state, such that they may engage a fluid container, for example at a lip at or near an aperture of the fluid container.

In the sectional view of FIG. 4, cavity 402 within main body 102 is visible. Inside cavity 402, main body 102 has internal surface 400. The sectional view of FIG. 4 shows the cap 100 in the secure state, with the secure segments 202 of latches 114 protruding into cavity 402.

Internal surface 400 is located at a radial center of cap 100, inside cavity 402 within main body 102. Internal surface 400 is a flat surface. Internal surface 400 may be an end of a protrusion of main body 102 into the cavity 402. The protrusion may be, for example, cylindrical in shape, with internal surface 400 being a circular flat surface. Internal surface 400 may be parallel to base 112 and top 110 of main body 102. When cap 100 is affixed to a fluid container, internal surface 400 may abut a seal (for example, seal 508 shown in FIG. 5 and described in detail below) enclosing an aperture of the fluid container.

Cavity 402 is an open space within main body 102. Cavity 402 may be sized to accommodate a portion of a fluid container or a threading adapter, such as threading adapter 502 shown in FIG. 5 and described in detail below, attached to a fluid container, such as threading adapter 502, shown in FIG. 5 and described in detail below. When cap 100 is in the secure state, secure portions 202 of latches 114 may extend into cavity 402 to engage with the portion of the fluid container or the threading adapter 502, such that they affix cap 100 to the fluid container or the adapter. The opening of cavity 402 may be circular in cross-section. The bottom 112 of main body 102 may include an opening corresponding to cavity 402, for example, in an embodiment, the bottom 112 of main body 102 is ring-shaped when separated from the rest of main body 102.

Figure 5:
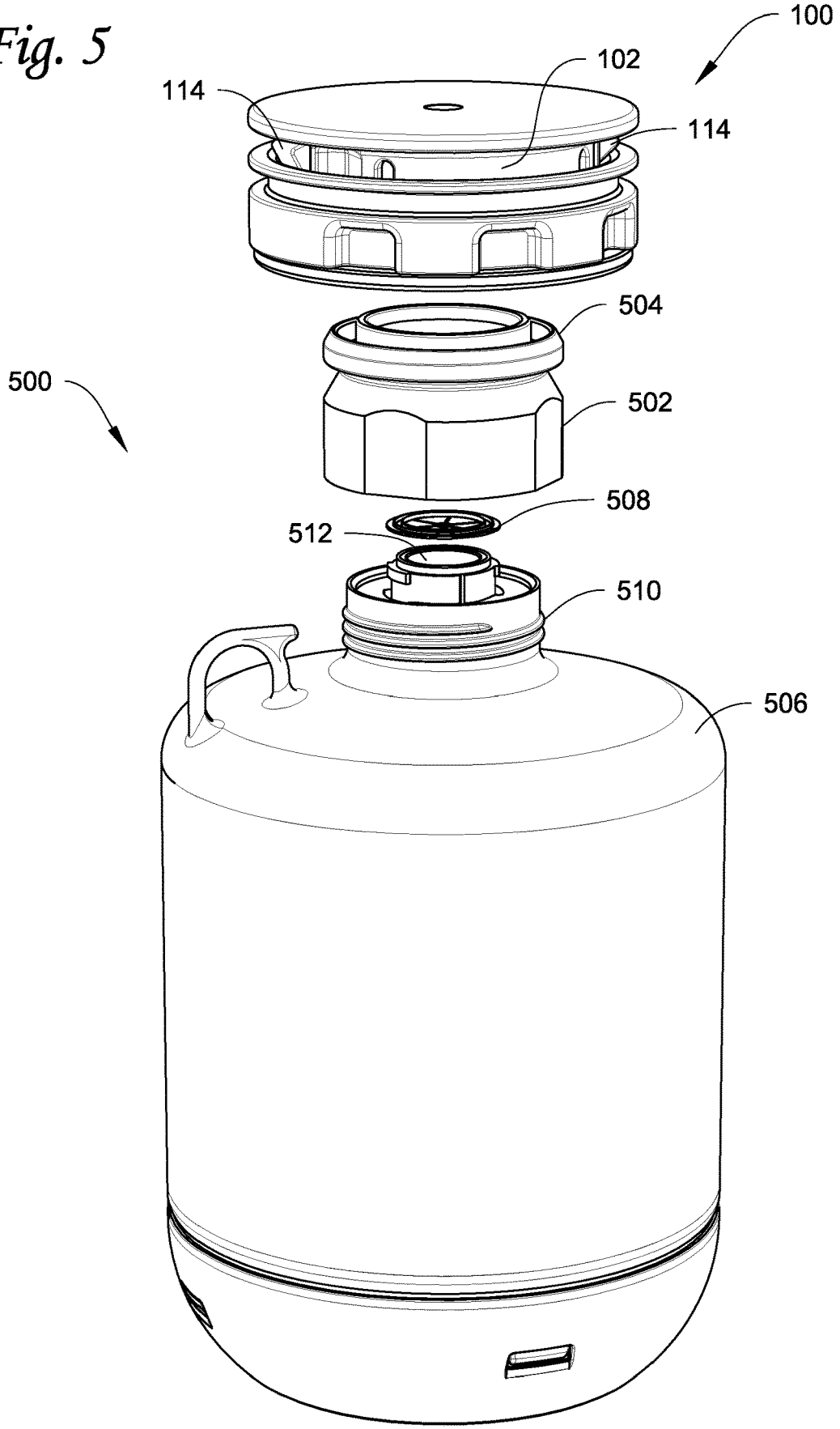
FIG. 5 is an exploded perspective view of a containment system for a fluid, according to an embodiment.

FIG. 5 is an exploded perspective view of a containment system 500 for a fluid according to an embodiment. Cap 100 engages with a threading adapter 502, located attached to a fluid container 506 near an aperture 512. Cap 100 engages threading adapter 502 at a lip 504. Threading adapter 502 is attached to fluid container 506, for example via a threaded connection at threaded portion 510 at or near the aperture 512 of the fluid container 506. Seal 508 may be disposed between threading adapter 502 and fluid container 504.

Threading adapter 502 includes lip 504. Threading adapter 502 has an open central portion extending through the center of the threading adapter, and lip 504 surrounds this open central portion at an end of threading adapter 502 opposite the threading that interfaces with fluid container 506. Threading adapter 502 may be affixed to fluid container 506 via threads at an end of the threading adapter 502 opposite the end having lip 504 interfacing with a threaded portion 510 at or near the aperture 512 of fluid container 506. Threading adapter 502 provides an interface allowing fluid container 506 to be adapted for use with cap 100. Threading adapter 502 may be made of, for example, metals such as aluminum or polymer materials such as high-density polyethylene (HDPE), polyether ether ketone (PEEK), perfluoroalkoxy alkane (PFA), or any other suitable melt-processed polymers, or combinations thereof. The material used for threading adapter 502 or particularly for lip 504 of threading adapter 502 may be selected based on the materials used for the main body 102 or the secure segment 202 of latch 114 (shown in FIG. 2) to reduce the production of fine materials.

Lip 504 may be an annular projection from threading adapter 502. The plurality of latches 114 of cap 100 may engage lip 504 when the cap 100 is placed on the threading adapter and latches 114 are in the secure state, preventing movement of the cap 100 and lip 504 relative to one another. Lip 504 may be shaped, and latches 114 of cap 100 arranged, such that the engagement of cap 100 to fluid container 506 is rotation-agnostic and does not depend on the relative rotational orientations of the cap 100 and the fluid container 506.

Fluid container 506 is a container used to store a fluid. The fluid container shown in the embodiment of FIG. 5 is a bottle. In an embodiment, fluid container 506 is a canister. Fluid container 506 may be of any size, with examples including containers having capacities of one to four hundred liters, such as four, sixteen, one hundred, or two hundred liter containers. It will be appreciated that these sizes are examples and the size of fluid container 506 may be varied beyond this list within the principles of this disclosure. Fluid container 506 may include a bag containing fluid located within the bottle or canister, forming a bag-in-bottle or a bag-in-canister style container. In an embodiment, fluid container 506 may be made of one or more plastics, such as, for example, polyolefins including but not limited to polypropylene, high-density polyethylene, linear low-density polyethylene, or the like. In an embodiment, fluid container 506 may be made of one or more metals such as aluminum, aluminum alloys, stainless steel, and the like. In an embodiment, fluid container 506 is made of glass. It will be appreciated that the materials are examples and the actual materials for the fluid container 506 can vary beyond the stated list within the principles of this disclosure.

Fluid container 506 may include a threaded portion 510 surrounding the aperture 512 of the fluid container 506. Threaded portion 510 may engage with threads of threading adapter 502 to affix threading adapter 502 and thus lip 504 to the fluid container 506.

Seal 508 may be included in containment system 500. In an embodiment, seal 508 is at the aperture 512 of fluid container 506. Aperture 512 is an opening at an end of the fluid container, allowing the fluid to enter or exit the container. Aperture 512 may be circular in shape. In the embodiment shown in FIG. 5, seal 508 is circular in shape, corresponding to aperture 512. It will be appreciated that a size and shape of seal 508 may vary based on the size and shape of the aperture 512. Seal 508 may be a rupturable seal, for example, one that is ruptured by dispensing equipment during a manufacturing process when the fluid is to be dispensed during the manufacturing process. Seal 508 may be referred to as a breakaway seal, a break seal, or the like. In an embodiment, when cap 100 is engaged with lip 504, an inner surface 400 (FIG. 4) of main body 102 of cap 100 may abut the seal 508. When inner surface 400 of main body 102 abuts seal 508, this may provide protection and mechanical support to seal 508, reducing the chance of breakage during material handling, particularly in instances where fluid container 506 is dropped.

Figure 6:
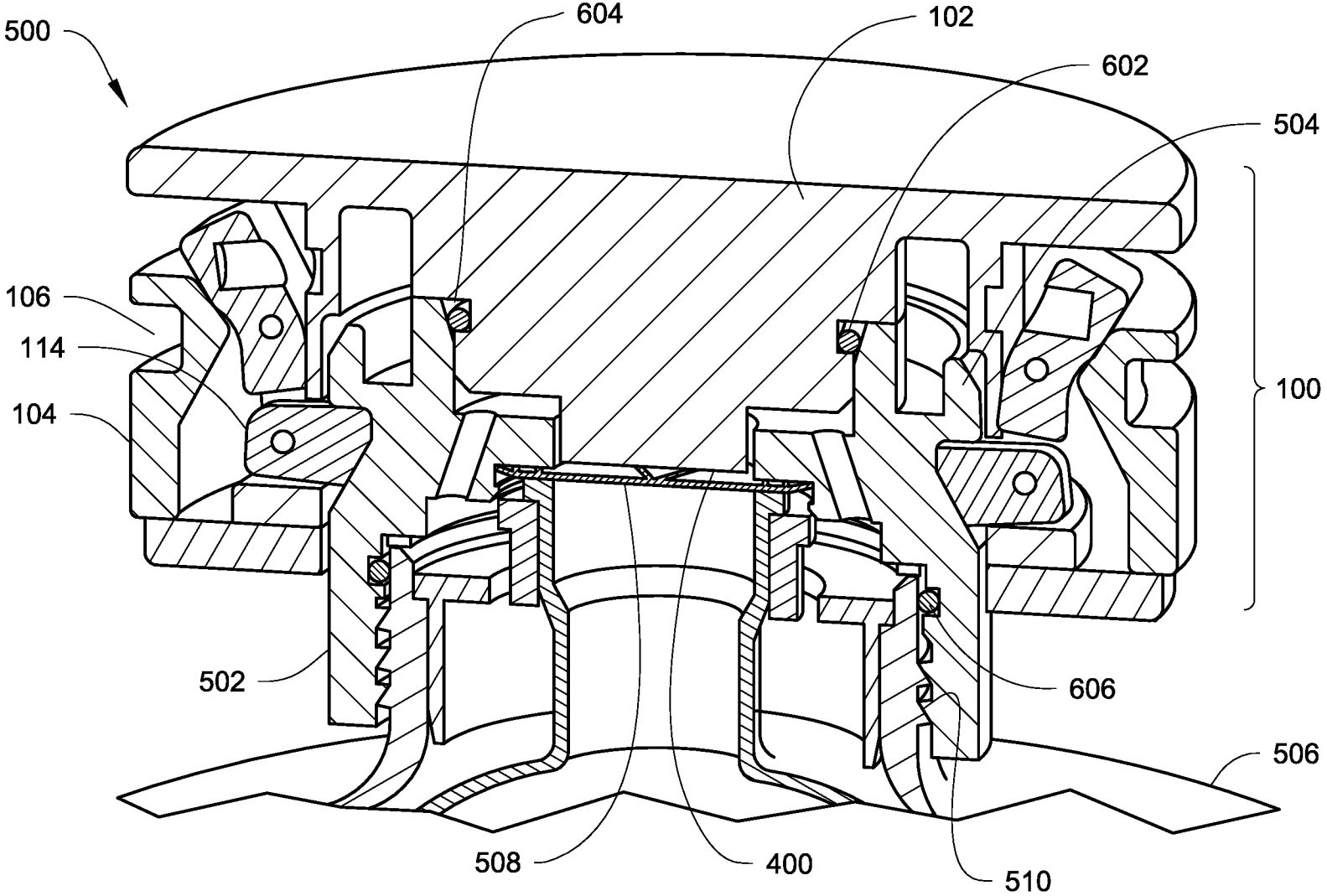
FIG. 6 is a sectional view of the containment system for a fluid of FIG. 5, according to an embodiment.

FIG. 6 is a sectional view of the containment system 500 for a fluid of FIG. 5, according to an embodiment. In the embodiment shown in FIG. 6, cap 100 is connected to threading adapter 502 via engagement of latches 114 in the secure position with lip 504. In the embodiment shown in FIG. 6, threading adapter 502 is connected to fluid container 506 by engagement with the threaded portion 510 of fluid container 506. Thus, cap 100 secures the closure of aperture 512 of the fluid container 506, and cap 100 may further support seal 508 using internal surface 400 of main body 102.

In the embodiment shown in FIG. 6, cap 100 includes a cap O-ring 602 positioned on main body 102 such that it can interface with threading adapter 502, for example on an inner side of lip 504. Cap O-ring may be, for example, rubber. Cap O-ring may be located in a groove 604. Groove 604 may be an annular groove around an inner surface of cap 100 facing cavity 402. Groove 604 may be parallel to the top 110 and base 112 of main body 102.

In the embodiment shown in FIG. 6, threading adapter 502 includes threading adapter O-ring 606. Threading adapter O-ring 606 may be disposed in a groove 608 formed in the threading adapter 502. Groove 608 may be formed in an interior surface of threading adapter 502, above the threading by which threading adapter 502 engages the fluid container 506.

In the embodiment shown in FIG. 6, the internal surface 400 of main body 102 of cap 100 protrudes into an aperture of threading adapter 502 to abut seal 508 located between the threading adapter 502 and the fluid container 506 at the aperture 512 of fluid container 506. Internal surface 400, by abutting seal 508, provides mechanical support to seal 508 to prevent premature breakage of seal 508, for example if fluid container 506 is dropped, or during the handling of fluid container 506 while cap 100 is attached, such as movement of fluid container 506 by a materials handling system.

Figure 7:
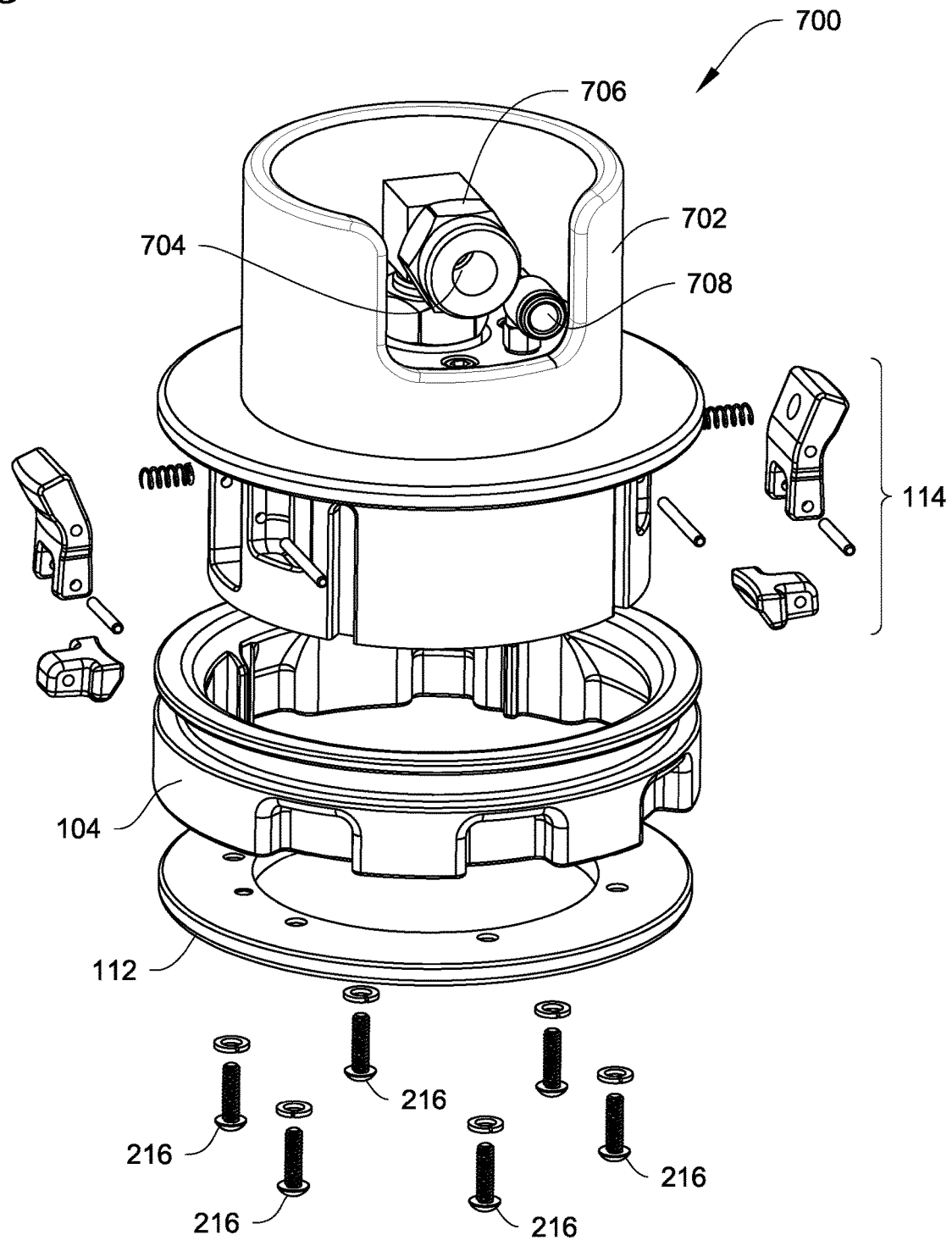
FIG. 7 is an exploded view of a dispense head for a fluid container according to an embodiment.

FIG. 7 is an exploded view of a dispense head 700 for a fluid container (e.g. 506 in FIG. 5), according to an embodiment. Dispense head 700 includes actuator ring 104, base 112, latches 114, and screws 216 as those items are described above and including their constituent components described above. Dispense head 700 includes dispense head main body 702.

Dispense head main body 702 includes a dispense outlet 704. Dispense outlet 704 is an aperture allowing fluid to flow out of the dispense head 700. Dispense outlet 704 may be an end of a channel through dispense head main body 702 configured to allow passage of a fluid out of a fluid container that dispense head 700 is attached to, such as fluid container 506 shown and detailed above. Dispense outlet 704 is located on an upper end of the dispense head 700, opposite the end interfacing with the fluid container such as fluid container 506. Dispense outlet 704 may be an extension from a channel passing through the radial center of the dispense head 700. Dispense outlet 704 may be surrounded by a connector 706, such as a threaded or quick-release connector, allowing connection of the dispense outlet 704 to a device consuming the fluid from the fluid container, such as a semiconductor manufacturing device.

In the embodiment shown in FIG. 7, dispense head main body 702 further includes a fluid inlet 708. Fluid inlet 708 is an aperture that may allow a fluid, for example air, to travel into a fluid container that the dispense head 700 is connected to. Fluid inlet 708 is located on an upper end of the dispense head 700, opposite the end interfacing with the fluid container such as fluid container 506. Fluid inlet 708 may be offset from a radial center of the dispense head 700. For example, fluid from fluid inlet 708 may be used to pressurize a portion within a bag-in-canister or bag-in-bottle fluid container that is outside of the bag, for example to facilitate the dispensing of fluid that is stored in the bag.

Figure 8:
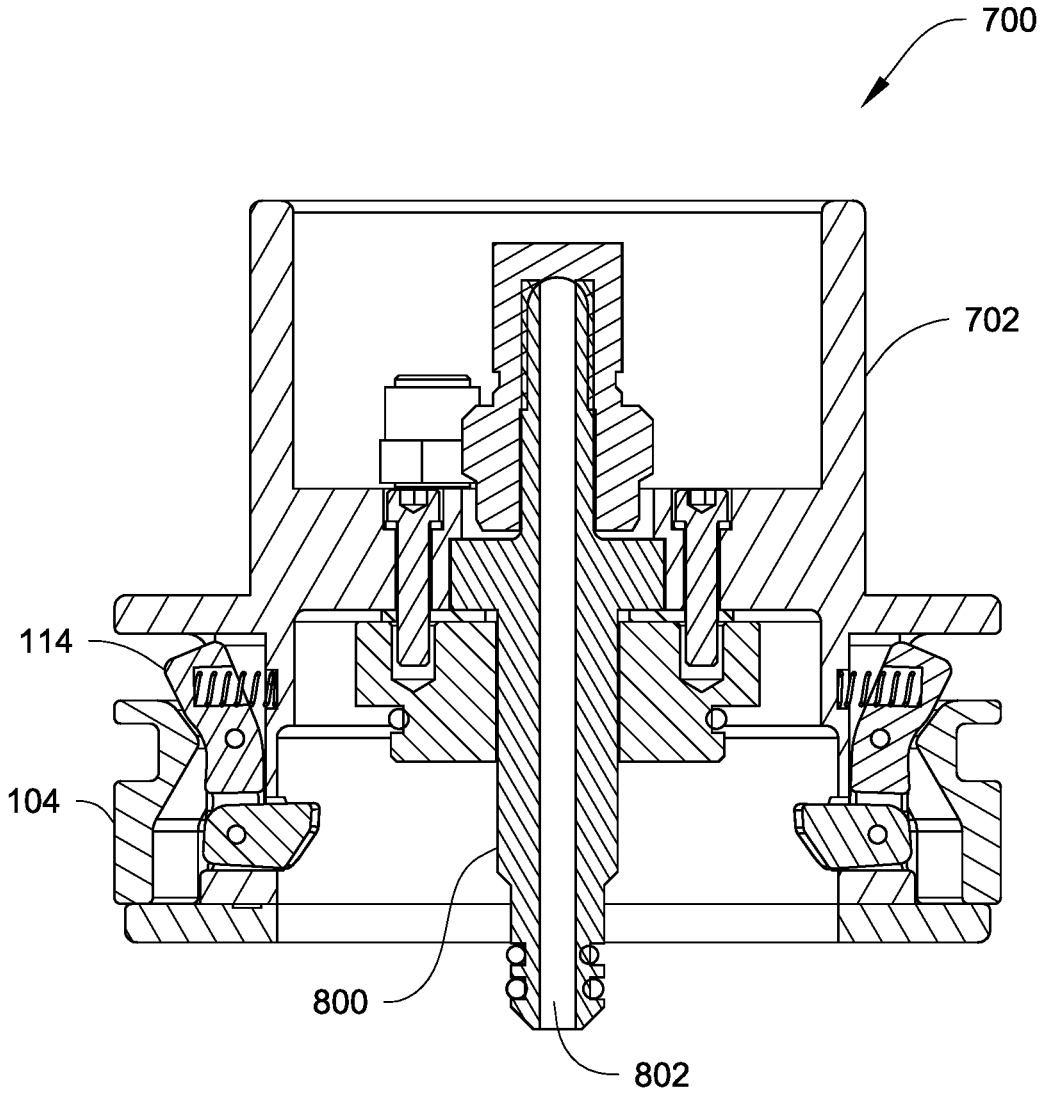
FIG. 8 is a sectional view of the dispense head for a fluid container of FIG. 7 according to an embodiment.

FIG. 8 is a sectional view of a dispense head according to the embodiment shown in FIG. 7. Actuator ring 104, bottom 112, and latches 114, and dispense head main body 702, as these are described above, are visible in the view of FIG. 8.

Dispense head main body 702 includes a protrusion 800. Channel 802 is formed through dispense head main body 702 including protrusion 800. Channel 802 provides a fluid path through the dispense head main body 702 from protrusion 800 to dispense outlet 704.

Figure 9:
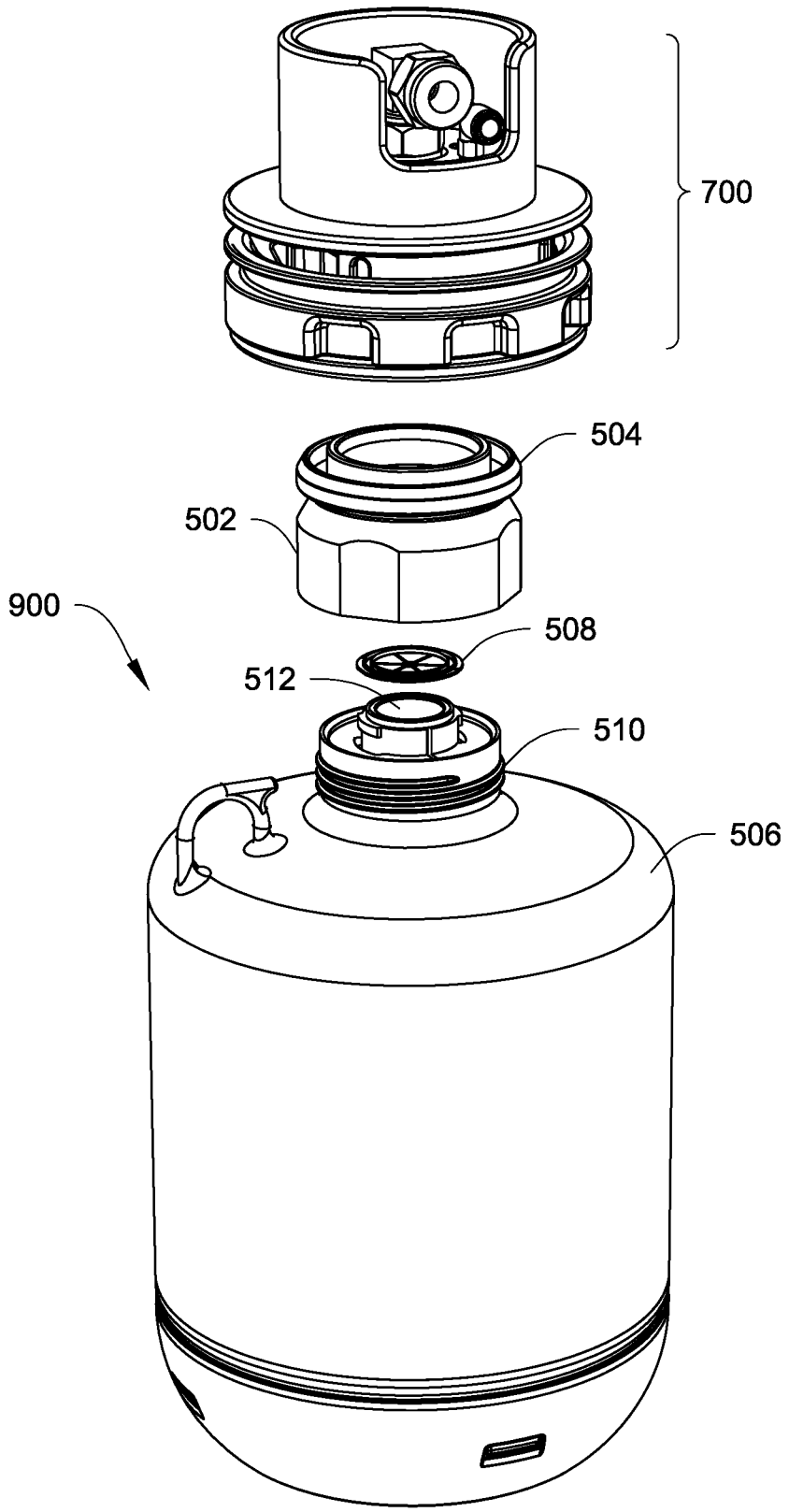
FIG. 9 is an exploded perspective view of a containment and dispensing system for a fluid, according to an embodiment.

FIG. 9 is an exploded perspective view of a containment and dispensing system 900 for a fluid, according to an embodiment. Containment and dispensing system 900 includes dispense head 700, and threading adapter 502 having lip 504, seal 508, and fluid container 506 having threaded portion 510 and aperture 512 as these are described above.

When the containment and dispensing system 900 is assembled, protrusion 800 (as shown in FIG. 8, not shown in the perspective of FIG. 9) may penetrate the seal 508 to rupture seal 508 and to allow fluid to be removed from the fluid container 506 via channel 802 to dispense outlet 704 shown in FIG. 7. In an embodiment, fluid container 506 is a bag-in-bottle or bag-in-canister container, and protrusion 800 enters the bag inside the bottle or canister.

Figure 10:
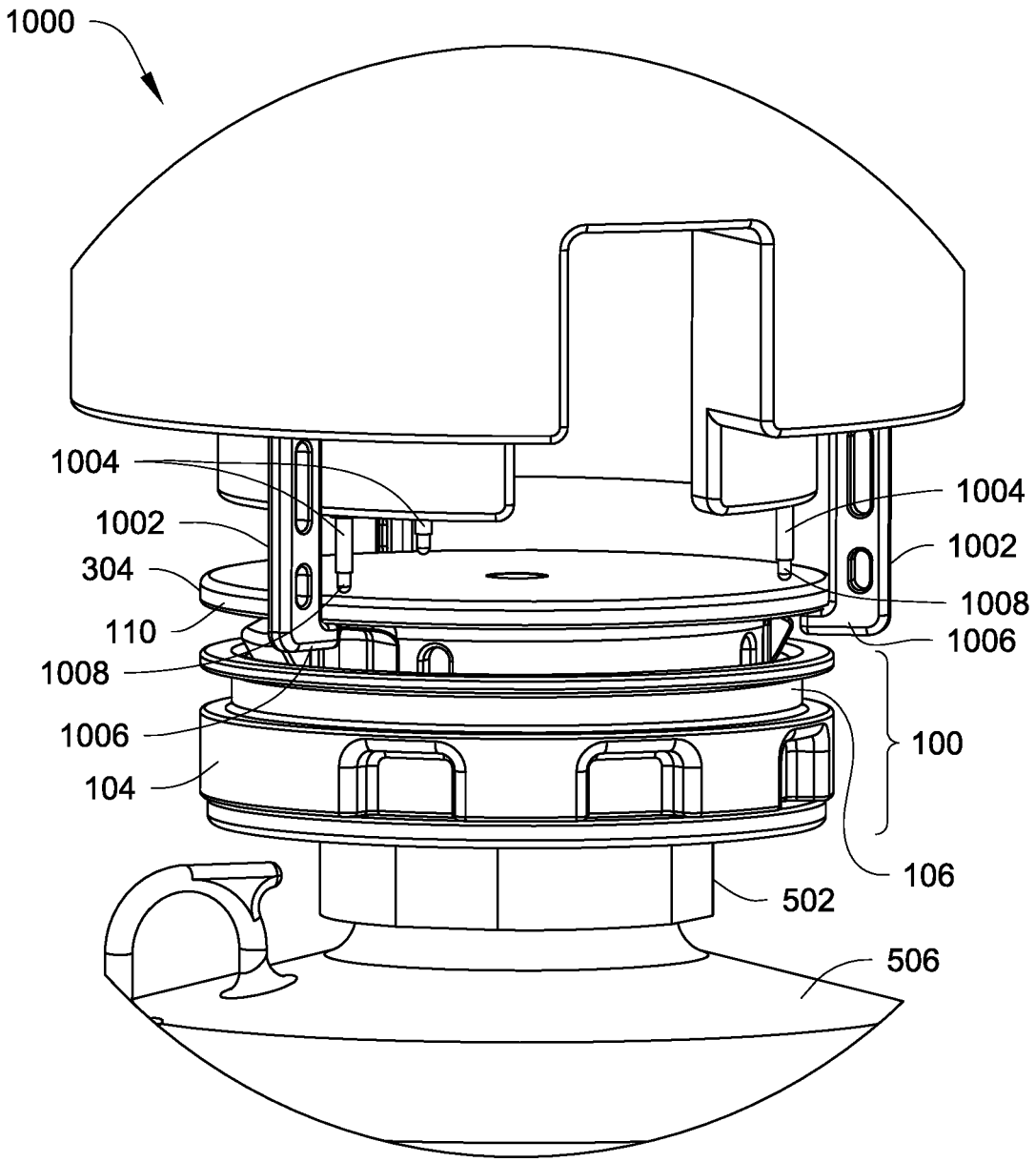
FIG. 10 is a perspective view of an automated materials handling system engaging a containment system for a fluid to transport the containment system, according to an embodiment.

FIG. 10 is a perspective view of an automated materials handling system 1000 engaging a containment system, such as 500 shown in FIG. 5, for a fluid to transport the containment system. Automated materials handling system 1000 may include two or more robotic arms 1002. Robotic arms 1002 may have engagement portions 1006 extending from each arm. Engagement portions 1006 may have a height smaller than the height of annular groove 106. In an embodiment, automated materials handling system 1000 includes three robotic arms 1002. In an embodiment, automated materials handling system includes at least one probe 1004. Probes 1004 may be cylindrical, with a rounded end, and extend in a vertical direction. In an embodiment, automated materials handling system 1000 include a probe 1004 for each robotic arm 1002.

As shown in FIG. 10, robotic arms 1002 may engage the top 110 of cap 100, for example by being positioned such that the extending portions located at and underneath outer edge 304. As shown in FIG. 10, the robotic arms 1002 may engage cap 100 without engaging actuator ring 104. With actuator ring 104 in its default position, latches 114 engage the fluid container 506 or a lip 504 (FIG. 5) of a threading adapter 502, and cap 100 remains secured to the fluid container or threading adapter 502. In this configuration, the engagement of robotic arms 1002 with cap 100 allows a fluid containment system such as fluid containment system 500 described above to be moved by movement of at least a part of the automated materials handling system 1000, for example to be transported from a storage location to a manufacturing device that will use the fluid contained in fluid container 506. In an embodiment, engagement portions 1006 of robotic arms 1002 are sized such that when they engage the top 110 of cap 100, they restrict the movement of actuator ring 104. For example, the height of the engagement portions 1006 may be such that when the engagement portions are underneath outer edge 304 of top 110, they physically interfere with the movement of actuator ring 104. In an embodiment, the restriction of movement of actuator ring 104 prevents actuator ring 104 from actuating latches 114 while the robotic arms 1002 engage cap 100. In an embodiment, robotic arms 1002 may engage the cap 100 at bottom 112 to move fluid containment system 500. In an embodiment, the movement operations may be performed on a containment and dispensing system such as containment and dispensing system 900 described above by engaging with cap 700 in accordance with the engagement with cap 100 described above.

Probes 1004 may be used to determine a position of the robotic arms 1002 with respect to the cap 100, for example to ensure that the position of the robotic arms 1002 is such that they do not engage the actuator ring 104 of cap 100 during the movement operation shown in FIG. 10, or to ensure engagement with the actuator ring 104 in the cap removal operation shown in FIG. 11 and described in detail below. Probes 1004 may be, for example, spring loaded, and use a spring force resulting from the contact of a tip 1008 of probe 1004 with top 110 of cap 100 to determine the position of robotic arms 1002.

Figure 11:
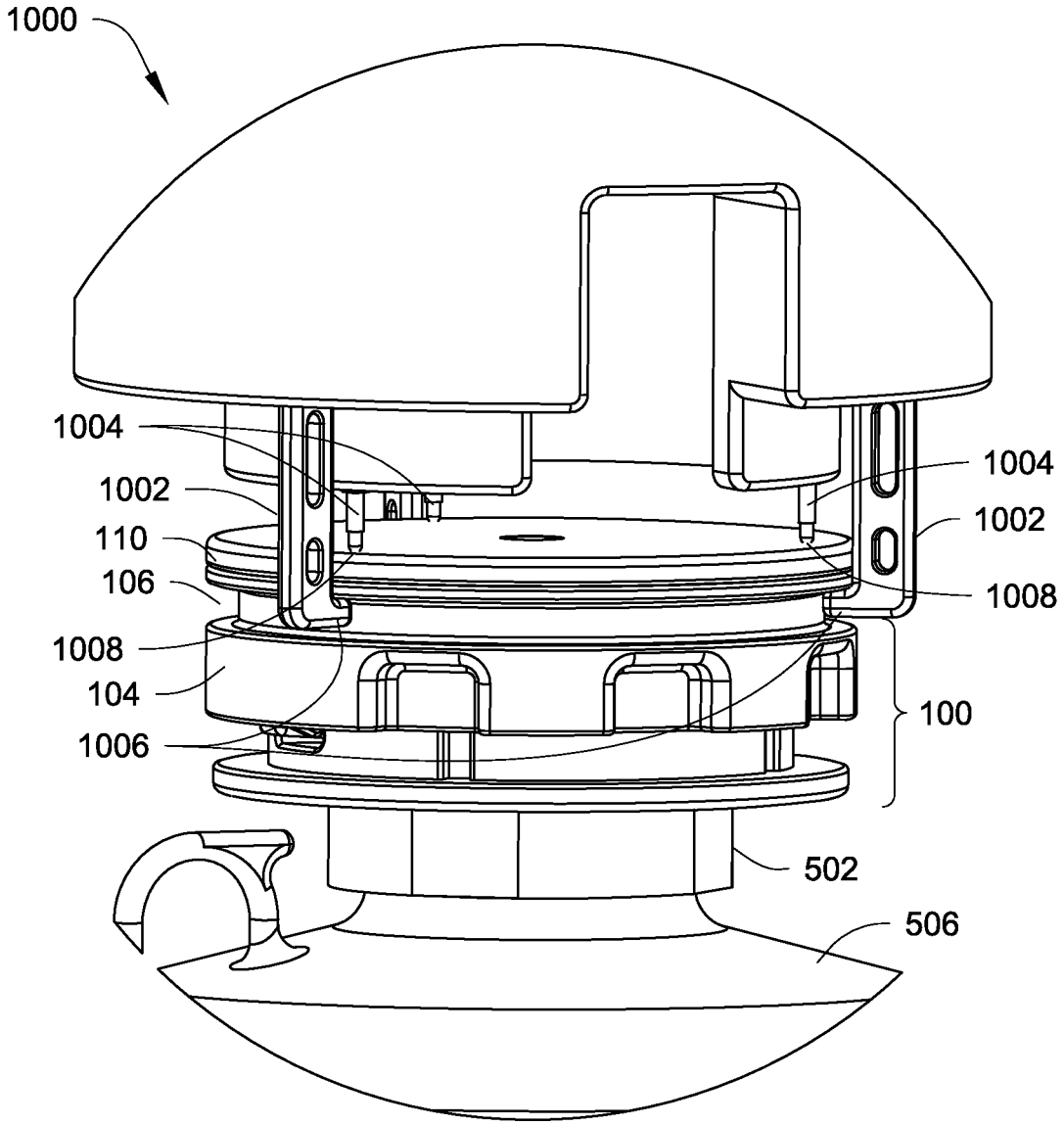
FIG. 11 is a perspective view of an automated materials handling system engaging containment system for a fluid to remove a cap, according to an embodiment.

FIG. 11 is a perspective view of an automated materials handling system 1000 engaging containment system for a fluid to remove a cap. As shown in FIG. 11, robotic arms 1002 of automated materials handling system 1000 engage actuator ring 104 of cap 100 at annular groove 106. By engaging actuator ring 104 at annular groove 106, robotic arms 1002 may operate actuator ring 104 regardless of a rotational orientation of cap 100 or the fluid container such as fluid container 506. This engagement may allow robotic arms 1002 to manipulate actuator ring 104, for example sliding actuator ring 104 along the main body 102 of cap 100 to actuate latches 114. In an embodiment, engagement surfaces 1006 of robotic arms 1002 are sized and shaped to mate with annular groove 1006. Robotic arms may engage actuator ring 104 in any rotational position relative to cap 100 due to their engagement at annular groove 106.

Probes 1004 may be used to detect a position of robotic arms 1002 with respect to cap 100 such that the robotic arms 1002 engage the annular groove 106 of the actuator ring 104. In an embodiment, the probes 1004 may further be used to press on top 110 of cap 100 to facilitate actuator ring 104 being slid over the resistance provided by latches 114 and the springs 208 (FIG. 2) or resilient material holding latches 114 in place. Probes 1004 may be, for example, spring loaded, and use a spring force resulting from the contact of a tip 1008 of probe 1004 with top 110 of cap 100 to determine the position of robotic arms 1002. Probes 1004 may further use that spring force to press on top 110, in order to facilitate movement of actuator ring 104 along main body 102 by the robotic arms 1002.

As shown in FIG. 11, actuator ring 104 has been slid vertically upwards along main body 102, towards top 110, to actuate latches 114. Latches 114 thus disengage from the lip 504 (FIG. 5; not visible in perspective of FIG. 11) of threading adapter 502, allowing cap 100 to be removed from fluid container 506. The cap 100 may, for example, be removed by lifting the cap 100 via the engagement with the robotic arms 1002 once the latches 114 have been released by the movement of actuator ring 104. This operation may be performed, for example, at a manufacturing device prior to attachment of a dispense head, such as dispense head 700 to the fluid container 506. This operation may also be performed when a dispense head 700 is attached to fluid container 506, for example via lip 504 of threading adapter 502, to remove dispense head 700 from fluid container 506. Dispense head 700 may be removed from fluid container 506, for example, when fluid container 506 has been emptied of fluid or at the conclusion of the manufacturing process using fluid from fluid container 506.

Figure 12A:
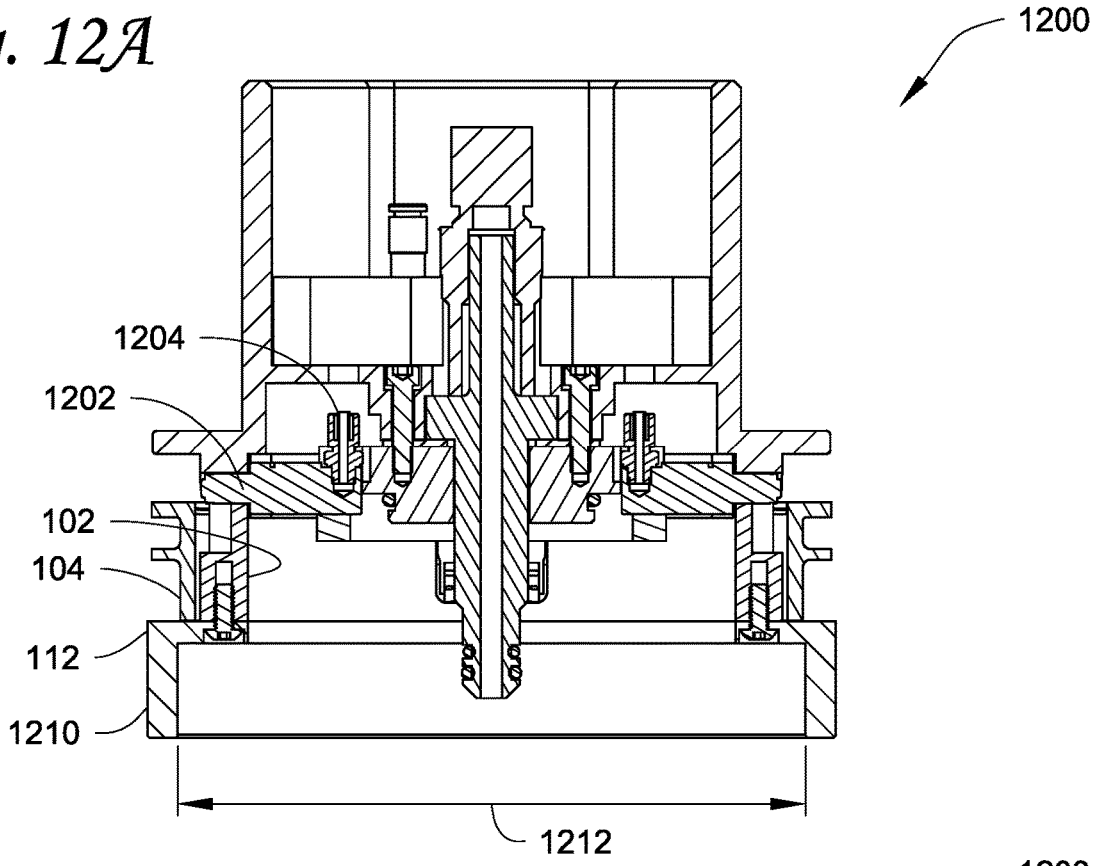
FIG. 12A and FIG. 12B are sectional views of a dispense head for a fluid container including a pressure locking system in retracted and deployed states, respectively, according to an embodiment.
Figure 12B:
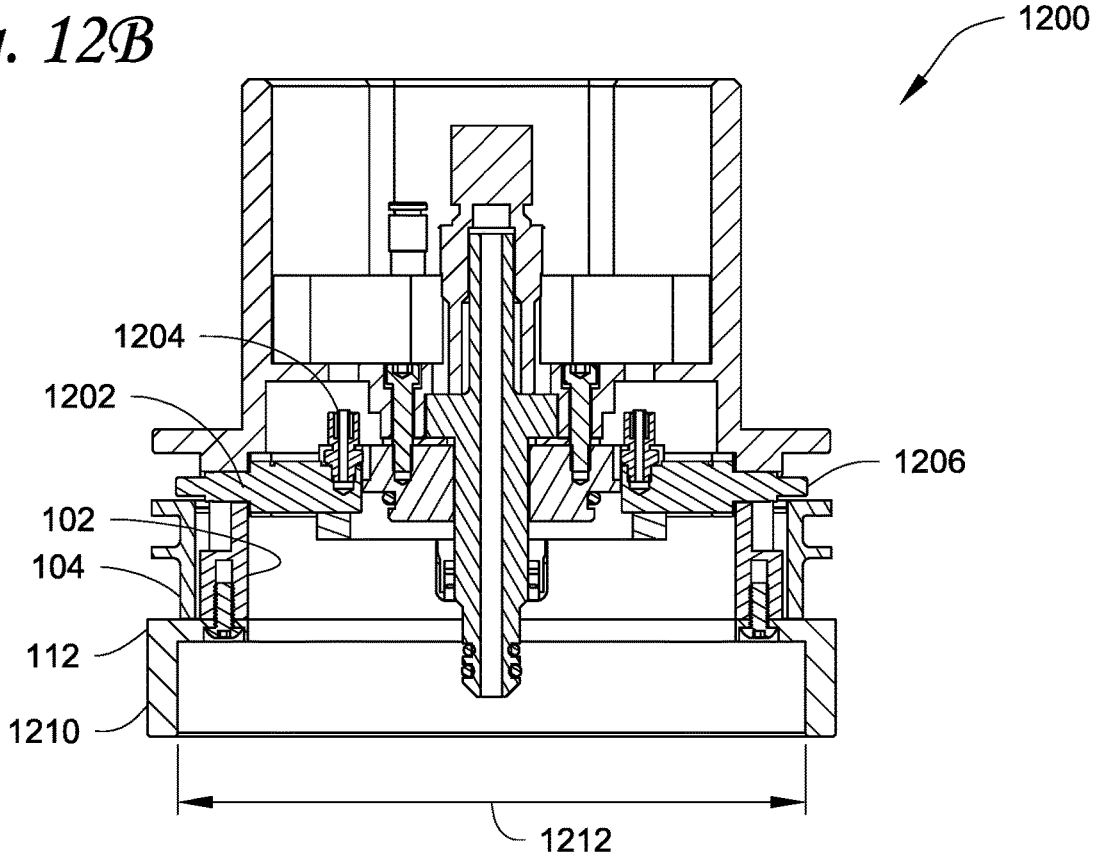

In an embodiment, an automatable closure may have a pressure-actuated locking system. FIGS. 12A and 12B show an embodiment of a dispense head 1200 having a pressure-actuated locking system including pressure-actuated locks 1202. The number of pressure-actuated locks 1202 may vary. For example, the illustrated embodiment includes two pressure-actuated locks 1202. In an embodiment, three pressure-actuated locks 1202 may be included. In an embodiment, the number of pressure-actuated locks 1202 can be the same as the number of latches 114.

FIGS. 12A and 12B show dispense head 1200 including pressure-actuated locks 1202. It is to be appreciated that embodiments such as cap 100 may similarly include pressure-actuated locks 1202.

Each pressure-actuated lock 1202 may include an orifice 1204 and a locking member 1206. In an embodiment, orifice 1204 is in fluid communication with the interior of a fluid container to which the dispense head 1200 is attached, such as fluid container 506 described above and shown in FIGS. 5 and 9. In an embodiment, orifice 1204 can receive the same pressure as the contents of the fluid container. Pressure received by orifice 1204 may be used to control a position of the locking member 1206.

Locking member 1206 may be configured to have a locking position where the locking member 1206 extends from pressure-actuated lock 1202 into a path over which actuator ring 104 is slid to actuate latches 114 and release dispense head 1200 from the fluid container and a release position where the locking member 1206 does not extend into the path of the actuator ring 104. FIGS. 12A and 12B are sectional views along a line that does not cross latches 114, which are thus not seen in FIGS. 12A and 12B.

In FIG. 12A, locking member 1206 is in the release position and cannot be seen as it is within pressure-actuated lock 1202.

In FIG. 12B, locking member 1206 is in the locking position and extends outwards from pressure-actuated lock 1202 into the path of actuator ring 104. Locking member 1206 may be located within a channel within pressure-actuated lock 1202. A position of locking member 1206 may be controlled by, for example, a spring and/or a resilient material located within pressure-actuated lock 1202, and fluid communication with orifice 1204, for example via the channel. In an embodiment, pressure received by fluid communication with orifice 1204 applies force on the locking member 1206, countered by force from the spring and/or resilient member such that when the pressure exceeds a selected value, locking member 1206 obstructs movement of actuator ring 104 and prevents dispense head 1200 from being removed from the fluid container so long as the pressure exceeds that selected value. The spring and/or resilient material can be selected to provide an amount of force based on the selected pressure value.

As shown in FIGS. 12A and 12B, dispense head 1200 further includes annular projection 1210 extending from base 112. Annular projection 1210 is formed at the outer perimeter of base 112 and extends in a direction away from the main body 102. Annular projection 1210 has an inner diameter 1212 that is larger than an outer diameter of a threading adapter, such as threading adapter 502 described above, and/or an aperture of a fluid container, such as aperture 512 described above. Annular projection 1210 may be configured to contact a fluid container such as 506 when dispense head 1200 is attached to the fluid container, for example by latches 114 in their secure state. The annular projection 1210 can, for example, reduce a side-to-side wobble or movement of the dispense head 1200.

Aspects:

It is noted that any one of aspects 1-8 can be combined with any one of aspects 9-15 or 16-20. Any one of aspects 9-15 can be combined with any one of aspects 16-20.

Aspect 1: A cap for a fluid container, comprising:

a main body, including a plurality of latches, the plurality of latches having a release state and a secure state, the plurality of latches configured to be in the release state when a portion of each of the plurality of latches are depressed; and an actuator ring, including:

an annular groove disposed on an outer side of the actuator ring; and an actuation surface disposed on an inner side of the actuator ring, wherein the actuator ring is slidable along the main body between at least a first position wherein the actuation surface does not depress the portion of each of the plurality of latches, and a second position wherein the actuation surface depresses the portion of each of the plurality of latches and the plurality of latches are in the release state.

Aspect 2: The cap according to aspect 1, wherein the plurality of latches each include a spring configured to hold each latch in the secure state.

Aspect 3: The cap according to any of aspects 1-2, wherein the plurality of latches each include a resilient material configured to hold each latch in the secure state.

Aspect 4: The cap according to any of aspects 1-3, wherein the main body includes at least one of polyether ether ketone or aluminum.

Aspect 5: The cap according to any of aspects 1-4, further comprising a close-range communication tag.

Aspect 6: The cap according to any of aspects 1-5, wherein the main body further comprises at least one aperture through which fluid may pass into or out of the container.

Aspect 7: The cap according to any of aspects 1-6, wherein a portion of the main body has an outer diameter smaller than an inner diameter of the actuator ring.

Aspect 8: A closure system for a fluid container, comprising:

a lip attached to the fluid container, and a cap, the cap including:

a main body, including a plurality of latches, each of the plurality of latches having a release state and a secure state, each of the plurality of latches configured to be in the release state when a portion of each of the plurality of latches are depressed; and an actuator ring, including:

an annular groove disposed on an outer side of the actuator ring; and an actuation surface disposed on an inner side of the actuator ring, wherein the actuator ring is slidable along the main body between at least a first position wherein the actuation surface does not depress the portion of each of the latches, and a second position wherein the actuation surface depresses the portion of each of the latches and the latches are in the release state, and wherein the plurality of latches engage the lip when in the secure state.

Aspect 9: The closure system according to aspect 8, wherein the main body includes a wall extending from a side facing the fluid container towards the fluid container, wherein the wall is configured to fit over the lip when the cap is installed on the container.

Aspect 10: The closure system according to any of aspects 8-9, wherein the lip is attached to the container via a threaded connector.

Aspect 11: The closure system according to aspect 10, wherein the threaded connector comprises a breakable seal configured to seal the contents of the fluid container.

Aspect 12: The closure system according to aspect 11, wherein a portion of the main body abuts the seal when the plurality of latches engages the lip.

Aspect 13: The closure system according to any of aspects 8-10, wherein the lip is formed integrally with the container.

Aspect 14: The closure system according to any of aspects 8-13, wherein engagement of the plurality of latches with the lip when in the secure state is rotation-agnostic.

Aspect 15: The closure system according to any of claims 8-14, wherein the cap further comprises a pressure lock, the pressure lock including: an inlet configured to receive a pressure from an inside of the fluid container; and a locking member, configured to protrude from the pressure lock into a path over which the actuator ring is slidable along the main body when the pressure received from the inside of the fluid container exceeds a predetermined amount of pressure.

Aspect 16: A method for automated handling of a container, comprising:

engaging, via a robotic arm, an annular groove on an actuator ring of a container cap;

driving the actuator ring with respect to a main body of the container cap to release one or more latches disposed on the main body of the container cap; and removing the container cap from the container.

Aspect 17: The method according to aspect 16, further comprising attaching a dispensing head to the container via the robotic arm.

Aspect 18: The method according to any of aspects 16-17, further comprising:

transporting the container via an overhead materials handling system, including:

engaging the container cap with the overhead materials handling system, wherein the actuator ring of the container cap is in a closed position.

Aspect 19: The method according to aspect 18, wherein engaging the container cap includes restricting movement of the actuator ring of the container cap.

Aspect 20: The method according to any of aspects 16-19, wherein engaging the annular groove on the actuator ring via the robotic arm is rotation-agnostic.

The terminology used in this specification is intended to describe particular embodiments and is not intended to be limiting. The terms "a," "an," and "the" include the plural forms as well, unless clearly indicated otherwise. The terms "comprises" and "comprising," when used in this specification, specify the presence of the stated features, integers, steps, operations, elements, or components, but do not preclude the presence or addition of one or more other features, integers, steps, operations, elements, or components.

With regard to the preceding description, it is to be understood that changes may be made in detail, especially in matters of the construction materials employed and the shape, size, and arrangement of parts without departing from the scope of the present disclosure. This specification and the embodiments described are exemplary only, with the true scope and spirit of the disclosure being indicated by the claims that follow.

What is claimed is:

1. A closure system for a fluid container, comprising:

a lip attached to the fluid container, and a cap, the cap including:

a main body having a cylindrical body portion including a plurality of latches, each of the plurality of latches having a release state and a secure state, each of the plurality of latches configured to be in the release state when a portion of each of the plurality of latches are depressed; and an actuator ring slidably disposed over the cylindrical body portion of the main body, the actuator ring including:

an annular groove formed in an outer surface of the actuator ring defining an exterior of the cap, the annular groove configured to receive and be engaged by a portion of an automated materials handling system; and an actuation surface disposed on an inner side of the actuator ring, wherein in operation of the actuator ring slides along the main body from at least a first position wherein the actuation surface does not depress the portion of each of the latches to a second position wherein the actuation surface depresses the portion of each of the latches and the latches are in the release state, wherein the plurality of latches engage the lip when in the secure state, and wherein the cap further comprises a pressure lock, the pressure lock including:

an inlet configured to receive a pressure from an inside of the fluid container; and a locking member, configured to protrude from the pressure lock into a path over which the actuator ring is slidable along the main body when the pressure received from the inside of the fluid container exceeds a predetermined amount of pressure.

2. The closure system of claim 1, wherein the main body includes a wall extending from a side facing the fluid container towards the fluid container, wherein the wall is configured to fit over the lip when the cap is installed on the container.

3. The closure system of claim 1, wherein the lip is attached to the container via a threaded connector.

4. The closure system of claim 3, wherein the threaded connector comprises a breakable seal configured to seal the contents of the fluid container.

5. The closure system of claim 4, wherein a portion of the main body abuts the seal when the plurality of latches engages the lip.

6. The closure system of claim 1, wherein the lip is formed integrally with the container.

7. The closure system of claim 1, wherein engagement of the plurality of latches with the lip when in the secure state is rotation-agnostic.

8. A method for automated handling of a container, comprising:

engaging, via a robotic arm, an annular groove on an actuator ring of a container cap;

wherein the cap further comprises a pressure lock, the pressure lock including:

an inlet configured to receive a pressure from an inside of the fluid container; and a locking member, configured to protrude from the pressure lock into a path over which the actuator ring is slidable along the main body when the pressure received from the inside of the fluid container exceeds a predetermined amount of pressure, driving the actuator ring with respect to a main body of the container cap to release one or more latches disposed on the main body of the container cap; and removing the container cap from the container.

9. The method of claim 8, further comprising attaching a dispensing head to the container via the robotic arm.

10. The method of claim 8, further comprising:

transporting the container via an overhead materials handling system, including:

engaging the container cap with the overhead materials handling system, wherein the actuator ring of the container cap is in a closed position.

11. The method of claim 10, wherein engaging the container cap includes restricting movement of the actuator ring of the container cap.

12. The method of claim 8, wherein engaging the annular groove on the actuator ring via the robotic arm is rotation-agnostic.

* * * * *